US009567833B2

(12) United States Patent
Jannise et al.

(10) Patent No.: US 9,567,833 B2
(45) Date of Patent: Feb. 14, 2017

(54) SAND CONTROL ASSEMBLIES INCLUDING FLOW RATE REGULATORS

(71) Applicant: HALLIBURTON ENERGY SERVICES, INC., Houston, TX (US)

(72) Inventors: Richard C. Jannise, Houston, TX (US); Gregory W. Garrison, Carrollton, TX (US); John C. Gano, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/377,506

(22) PCT Filed: Aug. 20, 2013

(86) PCT No.: PCT/US2013/055797

§ 371 (c)(1),
(2) Date: Aug. 8, 2014

(87) PCT Pub. No.: WO2015/026330

PCT Pub. Date: Feb. 26, 2015

(65) Prior Publication Data

US 2016/0153263 A1 Jun. 2, 2016

(51) Int. Cl.

| | |
|---|---|
| ***E21B 43/14*** | (2006.01) |
| ***E21B 34/12*** | (2006.01) |
| ***E21B 43/02*** | (2006.01) |
| ***E21B 43/12*** | (2006.01) |
| ***E21B 43/08*** | (2006.01) |
| ***E21B 41/00*** | (2006.01) |
| *E21B 34/00* | (2006.01) |

(52) U.S. Cl.

CPC ..... *E21B 34/12* (2013.01); *E21B 41/0078* (2013.01); *E21B 43/02* (2013.01); *E21B 43/08* (2013.01); *E21B 43/12* (2013.01); *E21B 43/14* (2013.01); *E21B 2034/007* (2013.01)

(58) Field of Classification Search

CPC ..... E21B 34/12; E21B 2034/007; E21B 43/08
See application file for complete search history.

(56) References Cited

U.S. PATENT DOCUMENTS 5,934,376 A 8/1999 Nguyen et al.
6,257,338 B1 * 7/2001 Kilgore ..... E21B 33/1246 166/187

(Continued)

*Primary Examiner* — Matthew R Buck
*Assistant Examiner* — Aaron Lembo
(74) *Attorney, Agent, or Firm* — McGuireWoods LLP

(57) ABSTRACT

A sand control completion system comprises: (A) a first flow rate regulator, wherein the first flow rate regulator is positioned in a first interval of a wellbore, wherein the first flow rate regulator is part of a first sand control assembly; and (B) a second flow rate regulator, wherein the second flow rate regulator is positioned in a second interval of the wellbore, wherein the second flow rate regulator is part of a second sand control assembly, wherein a reservoir fluid is caused or allowed to simultaneously flow through the first and second flow rate regulators into a tubing string, wherein the reservoir fluid is commingled into a single fluid stream within the tubing string. A method of using the sand control completion system to simultaneously produce a reservoir fluid from more than one zone of a subterranean formation is also provided.

17 Claims, 7 Drawing Sheets

(56) References Cited

U.S. PATENT DOCUMENTS 6,857,476 B2 2/2005 Richards
6,994,170 B2 2/2006 Echols
7,055,598 B2 6/2006 Ross et al.
7,367,395 B2 5/2008 Vidrine et al.
8,215,406 B2 7/2012 Dale et al.
8,403,062 B2 3/2013 Dale et al.
8,960,287 B2 * 2/2015 Holderman ..... E21B 43/04 166/242.2
2003/0192689 A1 10/2003 Moake et al.
2004/0011534 A1 * 1/2004 Simonds ..... E21B 7/20 166/384
2004/0035578 A1 * 2/2004 Ross ..... E21B 43/08 166/250.15
2004/0173352 A1 * 9/2004 Mullen ..... E21B 17/028 166/278
2006/0060352 A1 * 3/2006 Vidrine ..... E21B 43/045 166/276
2006/0175052 A1 8/2006 Tips
2006/0196668 A1 9/2006 Burge et al.
2008/0283238 A1 11/2008 Richards et al.
2009/0078428 A1 3/2009 Ali
2010/0051262 A1 * 3/2010 Dusterhoft ..... E21B 47/01 166/236
2010/0051271 A1 * 3/2010 Gano ..... E21B 33/1208 166/278
2010/0236779 A1 9/2010 Nutley et al.
2010/0276160 A1 11/2010 Tolman et al.
2011/0308806 A9 * 12/2011 Dykstra ..... E21B 34/08 166/316
2012/0018153 A1 1/2012 Yeh et al.
2012/0199346 A1 8/2012 Patel et al.
2012/0199362 A1 8/2012 Grigsby et al.
2012/0298223 A1 * 11/2012 Krush ..... E21B 43/08 137/544
2014/0083714 A1 * 3/2014 Grigsby ..... E21B 43/10 166/373
2015/0013970 A1 * 1/2015 Jaaskelainen ..... E21B 47/123 166/250.01
2015/0034329 A1 * 2/2015 McGeoch ..... E21B 34/06 166/373
2015/0361765 A1 * 12/2015 Lopez ..... E21B 43/08 166/378

* cited by examiner

SAND CONTROL ASSEMBLIES INCLUDING FLOW RATE REGULATORS

TECHNICAL FIELD

The present disclosure relates generally to sand control systems and methods of simultaneously producing a reservoir fluid from more than one zone of a multi-zone formation. The sand control system includes at least a first and a second flow rate regulator. The first and second flow rate regulators can be positioned in a first and second interval of the wellbore respectively. The first and second flow rate regulators are incorporated within a sleeve of a first and second sand control assembly. According to an embodiment, the reservoir fluid is caused or allowed to simultaneously flow through the first and second flow rate regulators into a tubing string. The reservoir fluid can be commingled within the tubing string into a single fluid stream.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
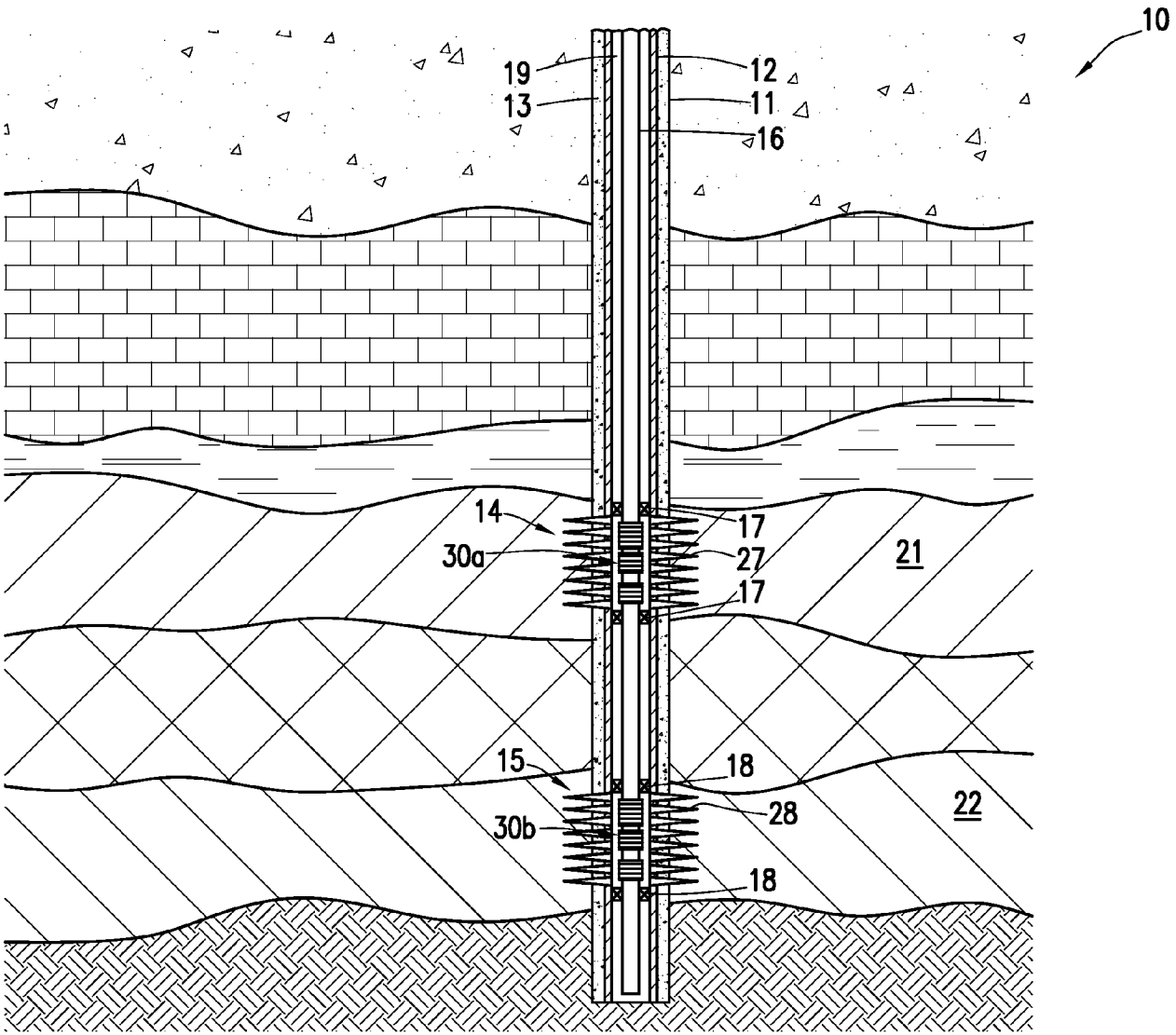
FIG. 1 is a schematic illustration of a well system containing a sand control completion system according to an embodiment.

As used herein, the words "comprise," "have," "include," and all grammatical variations thereof are each intended to have an open, non-limiting meaning that does not exclude additional elements or steps.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

It should be understood that, as used herein, "first," "second," "third," etc., and "upper" and "lower" are arbitrarily assigned and are merely intended to differentiate between two or more sand control assemblies, flow rate regulators, positions, etc., as the case may be, and does not indicate any particular orientation or sequence. Furthermore, it is to be understood that the mere use of the term "first" does not require that there be any "second," and the mere use of the term "second" does not require that there be any "third," etc.

Oil and gas hydrocarbons are naturally occurring in some subterranean formations. In the oil and gas industry, a subterranean formation containing oil, gas, or water is referred to as a reservoir. A reservoir may be located directly beneath land or offshore areas. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, an injection well, or a geothermal well. As used herein, a "well" includes at least one wellbore. The wellbore is drilled into a subterranean formation. The subterranean formation can be a part of a reservoir or adjacent to a reservoir. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiple zones of a formation. One or more zones of the formation can be isolated within the wellbore via the use of an isolation device. In this manner, portions of the annulus can be sealed so fluids will not flow through the annulus but rather will flow through the tubing string or casing. A packer is a common isolation device that is used to create multiple intervals in a wellbore. The isolation devices can be used to create multiple intervals of the wellbore. There can be one or more intervals of the wellbore that corresponds to a zone of the subterranean formation.

Sand control is a technique often used in soft rock, unconsolidated, or loosely consolidated formations. Examples of sand control techniques include, but are not limited to, using sand control assemblies, and gravel packing. A common sequence of sand control techniques is to first install a sand control assembly in the wellbore and then gravel pack the wellbore. Sand control assemblies often include a slotted liner and/or a screen. A slotted liner can be a perforated pipe, such as a blank pipe. The screen usually contains holes that are smaller than the perforations in the slotted liner. The liner and/or screen can cause bridging of the fines against the liner or screen as a reservoir fluid is being produced. Gravel packing is often performed in conjunction with the use of sand control assemblies. In gravel packing, a packer and a sand control assembly with a washpipe inside the assembly are usually run in the wellbore with a service tool. The gravel is then commonly placed in a portion of an annulus between the wall of the wellbore and the outside of the screen or tubing string at a location below the packer or in between a set of packers. The gravel helps to trap and restrain fines from entering the production equipment or plugging the holes in the liner or screen while at the same time stabilizing the formation or wellbore.

In some formations, it is often necessary to fracture a portion of the subterranean formation. Fracturing is a common stimulation treatment. A treatment fluid adapted for this purpose is sometimes referred to as a "fracturing fluid." The fracturing fluid is pumped at a sufficiently high flow rate and high pressure into the wellbore and into the subterranean formation to create or enhance a fracture in the subterranean formation. The fracture provides a highly-permeable flow path for a reservoir fluid to be produced. It is often desirable to create multiple fractures at multiple downhole locations.

Normally, in order to produce a reservoir fluid from a multi-zone formation, separate production tubing strings are run into the wellbore. Each production string is associated with a particular wellbore interval that corresponds to a particular zone of the formation. As the reservoir fluid is produced from each zone into each wellbore interval, the fluid flows through each production string to the wellhead. Obviously this system of production can be quite expensive and requires a multitude of wellbore equipment. There is technology that allows a reservoir fluid to be produced from a multi-zone formation into a single tubing string. An example of such a system is ESTMZ™—Enhanced Single-Trip Multizone Completion System—marketed by Halliburton Energy Services, Inc. The ESTMZ™ system is a sand-face, frac pack tool system that can allow an operator to isolate, treat, and produce from multiple wellbore intervals on one work string trip.

However, producing from multiple subterranean formation zones into a single tubing string can be challenging. For example, the amount of pressure and permeability can be different between subterranean formation zones. One zone can have a high pressure or high permeability while another zone can have a low pressure or low permeability. The flow rate of the produced reservoir fluid from the low pressure or low permeability zone will tend to be much less than the high pressure or high permeability zone. Currently, "intelligent" well completion systems can be used to regulate the flow rate of a produced fluid from a multi-zone formation. These intelligent well completion systems have to be installed in the tubing string after the installation of the sand control assembly. They are designed to open and close a production sleeve in the sand control assembly and to normalize the flow rate of fluid into the tubing string. However, these systems can be very expensive to install and maintain, and add significant length to the overall completion assembly.

Accordingly, there is a need for regulating the flow rate of produced reservoir fluids from a multi-zone formation that is inexpensive and does not significantly add complications or length to the completion system. It has been discovered that a flow rate regulator can be incorporated into a production sleeve of a sand control assembly. At least one sand control assembly can be positioned within each wellbore interval. The reservoir fluid can then be produced simultaneously from two or more zones of the subterranean formation whereby the flow rate regulators provide a consistent flow rate from each zone into a single production tubing string.

According to an embodiment, a method of simultaneously producing a reservoir fluid from more than one zone of a subterranean formation comprises: (A) positioning a first flow rate regulator in a first interval of the wellbore, wherein the first flow rate regulator is part of a first sand control assembly; (B) positioning a second flow rate regulator in a second interval of the wellbore, wherein the second flow rate regulator is part of a second sand control assembly; and (C) causing or allowing the reservoir fluid to simultaneously flow through the first and the second flow rate regulators into a tubing string, wherein the reservoir fluid is commingled into a single fluid stream within the tubing string.

Any discussion of the embodiments regarding the well system or any component related to the well system (e.g., a sand control assembly or flow rate regulator) is intended to apply to all of the apparatus and method embodiments. Any discussion of a particular component of an embodiment (e.g., a flow rate regulator) is meant to include the singular form of the component and the plural form of the component, without the need to continually refer to the component in both the singular and plural form throughout. For example, if a discussion involves "the flow rate regulator," it is to be understood that the discussion pertains to a flow rate regulator (singular) and two or more regulators (plural).

As used herein, the term "flow rate regulator" is meant to include any device that controls the inflow or flow rate of a fluid exiting the regulator and includes without limitation an inflow control device ("ICD") or an autonomous inflow control device ("AICD"). Inflow control devices, including AICDs, are commonly used to variably restrict the flow rate of a fluid. As used herein, the term "autonomous flow rate regulator" means an independent device, i.e., it is designed to automatically control the flow rate of a fluid without any external intervention.

Turning to the Figures, FIG. 1 is a schematic illustration of a well system 10. The well system 10 can include at least one wellbore 11. The wellbore 11 can penetrate a subterranean formation. The subterranean formation can be a portion of a reservoir or adjacent to a reservoir. The wellbore 11 can include an open-hole wellbore portion and/or a cased-hole wellbore portion. The wellbore 11 can include a casing 12. The casing 12 can be cemented in the wellbore 11 via cement 13. The casing 12 can include perforations that allow reservoir fluids from the subterranean formation to enter the interior of the casing 12. The wellbore 11 can include only a generally vertical wellbore section or can include only a generally horizontal wellbore section. A tubing string 16 can be installed in the wellbore 11. The tubing string 16 can be a production tubing string.

The subterranean formation can comprise at least a first zone 21 and a second zone 22. The subterranean formation can also include more than two zones, for example, the subterranean formation can further include a third zone, a fourth zone, and so on. The well system 10 can further include a first set of packers 17 and a second set of packers 18. The sets of packers 17/18 can be used to create at least two intervals of the wellbore. For example, the first set of packers 17 can create a first wellbore interval 14 and the second set of packers 18 can create a second wellbore interval 15. The first wellbore interval 14 and the second wellbore interval 15 do not have to be adjacent to one another. Moreover, the first wellbore interval 14 and the second wellbore interval 15 could be located in the middle portion of the wellbore, near a heel of the wellbore or closer to, or at, the toe of the wellbore. The first wellbore interval 14 can correspond to the first zone 21 and the second wellbore interval 15 can correspond to the second zone 22.

The packers 17/18 can be used to prevent fluid flow between the intervals 14/15 via an annulus 37. Of course, there can be more than two wellbore intervals. Moreover, there can be more than one wellbore interval that corresponds to a particular subterranean formation zone. A first set of fractures 27 can penetrate the first zone 21 and a second set of fractures 28 can penetrate the second zone 22.

It should be noted the well system 10 that is illustrated in the drawings and is described herein is merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other wellbore components not depicted in the drawing. By way of example, cement may be used instead of packers to aid in providing zonal isolation. Cement may also be used in addition to packers.

The methods include the step of positioning a first flow rate regulator 50 in the first wellbore interval 14, wherein the first flow rate regulator 50 is part of a first sand control assembly 30*a*; and positioning a second flow rate regulator 50 in the second wellbore interval 15, wherein the second flow rate regulator 50 is part of a second sand control assembly 30*b*.

Figure 2:
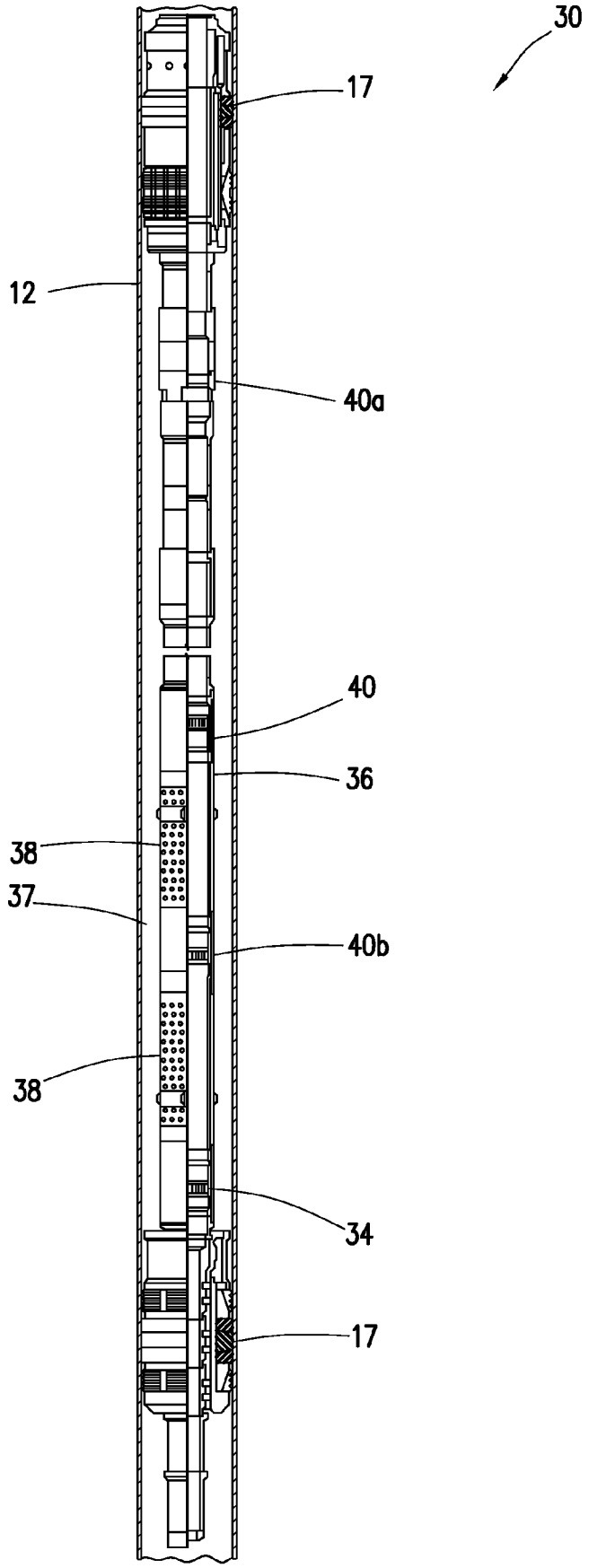
FIG. 2 is a cross-sectional view of a sand control assembly according to an embodiment.

FIG. 2 is a schematic illustration of a sand control assembly 30. The sand control assembly 30 can include a base pipe 36. The base pipe 36 can have an opening(s) that allows the flow of fluids into the production tubing 16. The term openings as used herein is intended to encompass any type of discontinuity in the base pipe 36 that allows fluids to flow into the pipe, including, but not limited to, perforations, holes and slots of any configuration that are presently known in the art or subsequently discovered.

The sand control assembly 30 can include a sand control screen 38, wherein the sand control screen 38 is positioned around an outer dimension of the base pipe 36. The sand control screen 38 can be porous to fluids while substantially restricting particulate material of a predetermined size from passing through the pores of the screen. The sand control screen 38 may be a wire-wrapped, sintered metal, or other type of screen. An annulus 37 can exist between the outside of the sand control assembly 30 and the inside of the casing 12 or the wall of the wellbore 11 (for open-hole completions).

The sand control assembly 30 can include one or more sleeve assemblies 40 positioned within or adjacent to the sand control screen 38. The sleeve assemblies will be described in more detail with reference to FIGS. 3A-4B. The sleeve assemblies can include one or more ports 44. When the sleeve assembly is in an open position, the port 44 allows fluid flow through the port, and in the closed position, fluid flow is prohibited or restricted from flowing through the port. The sleeve assemblies 40 can be without limitation a closing sleeve, a fracturing/circulating sleeve, or a production sleeve. A gravel slurry (not shown) can be introduced from a tubing string through an open sleeve assembly 40*a* and into the annulus 37. The gravel can remain in the annulus, while the carrier fluid can be returned to the wellhead through an open circulating sleeve 34 and the upper tubing by casing annulus 19. The open circulating sleeve 34 can be screened and have a lower flow resistance to fluid flow in order for the gravel to remain in the annulus and the gravel pack fluid can drain out or dry the gravel. During gravel packing operations, production sleeve 40*b* is generally closed.

Figure 3A:
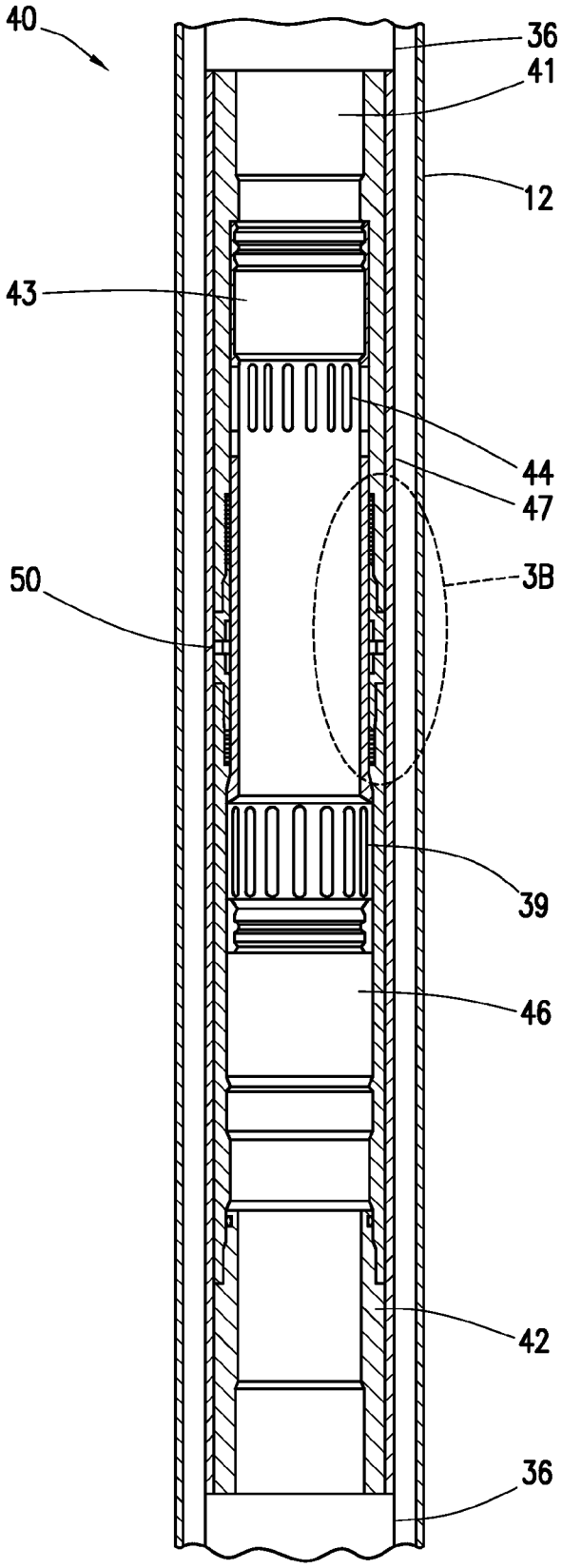
FIG. 3A is a cross-sectional view of a sand control completion system with a closed sleeve.
Figure 3B:
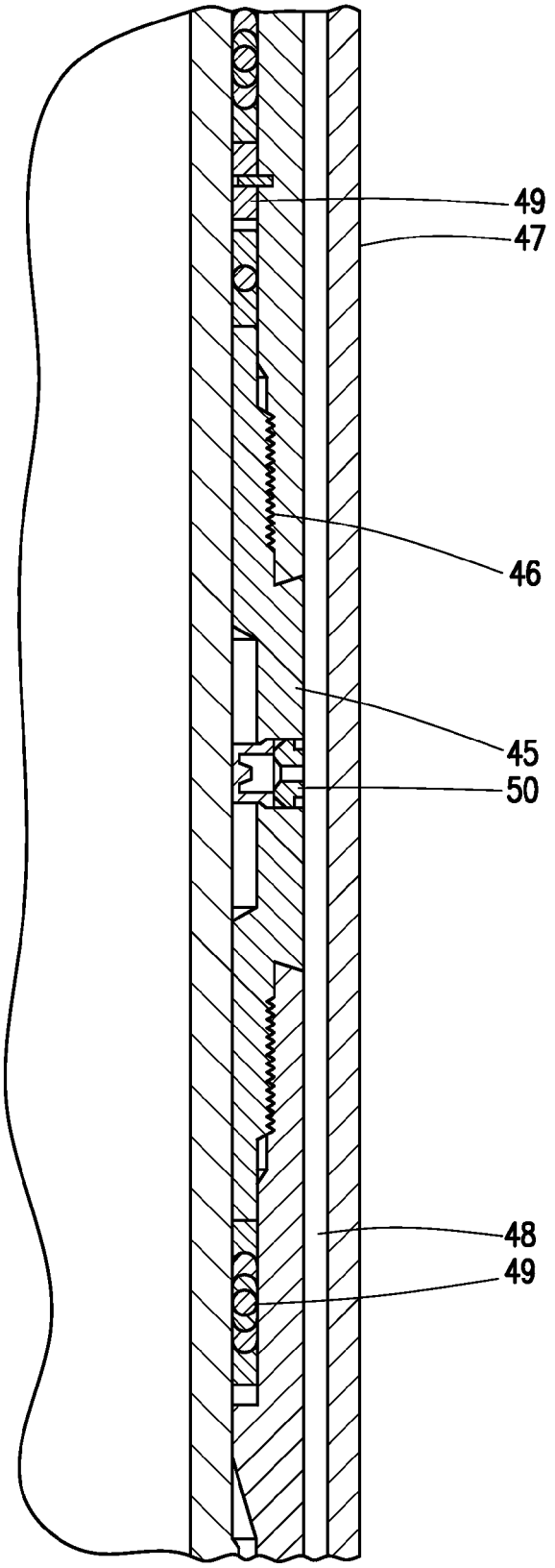
FIG. 3B is an enlarged view from FIG. 3A showing a flow rate regulator when the sleeve is in the closed position.

Referring now to FIGS. 3A and 3B, the sleeve assembly 40 can include a sliding sleeve 43. The sliding sleeve 43 can be connected to the base pipe 36 via an upper sub 41 and a bottom sub 42. The interior surfaces of the sliding sleeve 43 can include a recessed profile that receives a key set carried on a shifting tool (not shown). The sliding sleeve 43 can be slidably shifted in an axial direction relative to base pipe 36 via an upward or downward force on the sliding sleeve 43. The sliding sleeve 43 can be shifted to an open or closed position via the upward or downward force. The methods can include opening or closing one or more sleeves of the sleeve assemblies.

The sleeve assembly 40 can also include a housing 46, wherein the housing can be sealably connected to the sliding sleeve 43 via one or more seals 49 and a collet 39 or other suitable device, such as a dog or pin. The housing 46 can include an adaptor 45. The flow rate regulator 50 can be positioned within the adaptor 45. The adaptor can be threaded to the housing via male or female threads. The adaptor can be a nipple. The flow rate regulator 50 and any component of the flow rate regulator 50 can be made from a variety of materials. The sleeve assembly 40 can include a shroud 47 that surrounds the components of the sleeve assembly. The shroud 47 can form a housing annulus 48 located between the outside of the housing 46 and the inside of the shroud 47. In this manner, fluid can flow from the annulus 37, through the sand control screen 38, into the housing annulus 48, and towards the flow rate regulator 50. The flow rate regulator 50 can include a fluid inlet and a fluid outlet, such that fluid is capable of flowing through the flow rate regulator 50.

It is to be understood that the flow rate regulator 50 can be part of any of the production sleeve assemblies of the sand control assembly 30. Moreover, there can be one flow rate regulator 50 for each and every production sleeve assembly. While it may be common for a sand control assembly to include only two sleeve assemblies, a third, fourth or so on, additional production sleeve assemblies can be included in the sand control assembly. Preferably, all of the production sleeve assemblies include a flow rate regulator 50. The sleeve assembly 40 containing the flow rate regulator 50 can be positioned anywhere along the sand control assembly 30. According to an embodiment, the sleeve assembly 40 containing the flow rate regulator 50 is positioned inside the sand control screen 38.

According to the present disclosure, the flow rate regulator 50 can be used to variably restrict or regulate the flow rate of a fluid entering the tubing string 16. The flow rate regulator 50 can be an integral part of the sand control assembly 30. This obviates the need for an extraneous intelligent system. The flow rate regulator 50 can be a passive or an autonomous flow rate regulator. Accordingly, no external intervention is required to operate the flow rate regulator during production.

Figure 4A:
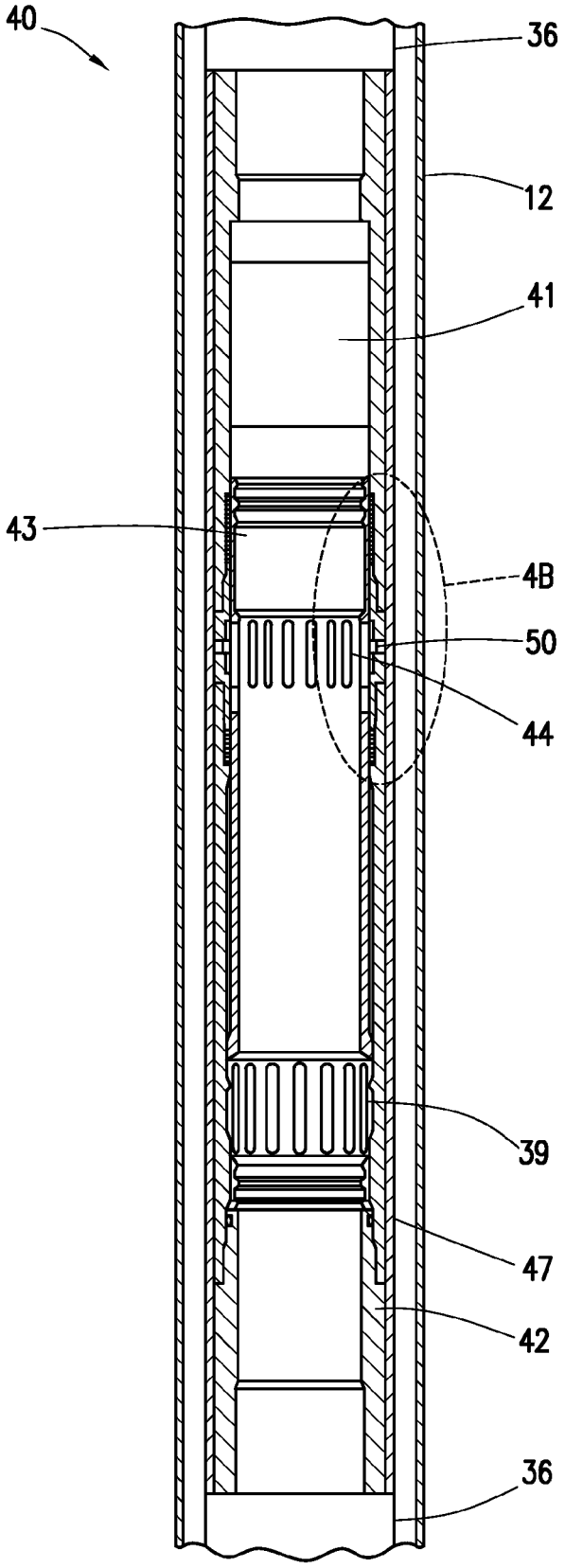
FIG. 4A is a cross-sectional view of a sand control completion system with an open sleeve.
Figure 4B:
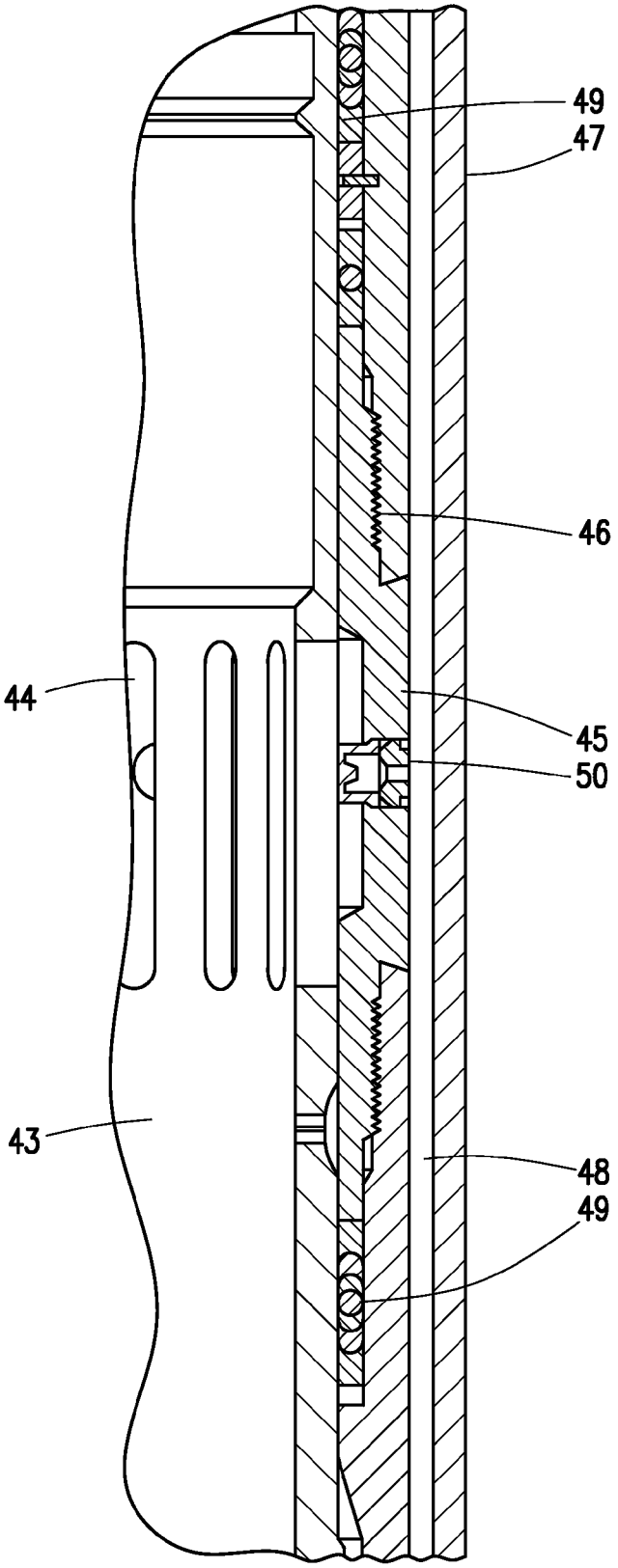
FIG. 4B is an enlarged view from FIG. 4A showing the flow rate regulator when the sleeve is in the open position.

FIGS. 4A and 4B depict the sliding sleeve 43 of the sleeve assembly 40 in an open position; whereas FIGS. 3A and 3B depict the sliding sleeve in a closed position. As can be seen in FIGS. 4A and 4B, when the sliding sleeve is shifted (e.g., via a shifting or service tool) into the open position, the port 44 of the sliding sleeve 43 is in line with the fluid outlet of the flow rate regulator 50. In this manner, fluid can flow into the base pipe 36 and subsequently into the production tubing string 16. The sliding sleeve 43 can be in a closed position when the sand control assembly 30 is introduced into the wellbore and when production operations have not commenced. Additionally, once production operations have commenced, if it is determined that production should no longer continue, then the sliding sleeve 43 may be returned to a closed position. For example, if the formation fluids being produced through the sand control assembly 30 contain an undesirable percentage of water, then the sliding sleeve 43 can be closed. Once the sliding sleeve 43 is closed, the sand control assembly 30 no longer permits formation fluids to be produced.

In an embodiment, the sand control assembly 30 further includes a mechanism (not shown) that facilitates the alignment of the fluid outlet of the flow rate regulator/nozzle 50 with the port 44 of the sliding sleeve 43. In another embodiment, the port 44 of the sliding sleeve 43 may also include a mechanism (not shown) to ensure that the sleeve always remains a set distance away from the housing of the flow rate regulator/nozzle 50 to prevent erosional failure of the sliding sleeve 43.

The methods include causing or allowing the reservoir fluid to simultaneously flow through the first and second flow rate regulators 50. If more than two flow rate regulators, sand control assemblies, sleeve assemblies, and intervals are used, then the methods can further include causing or allowing the reservoir fluid to simultaneously flow through more than the first and second flow rate regulators, alternatively, all of the flow rate regulators.

The flow rate of the reservoir fluid entering the tubing string from the first and second flow rate regulators can be the same or different. The flow rate regulators 50 can be used to deliver a relatively constant flow rate of the reservoir fluid into the tubing string. According to an embodiment, the flow rate of the reservoir fluid from each flow rate regulator into the tubing string is similar. In some instances, it may be necessary to decrease the flow rate of the fluid exiting each flow rate regulator in order to provide a similar or balanced production flow from each formation zone. A flow rate regulator can be positioned within a sand control assembly that is introduced within a particular wellbore interval to regulate the flow rate of the fluid from that formation zone. The flow rate of reservoir fluid from the first zone 21 and the second zone 22 can be controlled. For example, if the formation permeability of the first zone 21 is significantly higher than the formation permeability of the second zone 22, then the first flow rate regulator 50 may be used to restrict the flow rate from the first zone 21 to a greater extent than the second flow rate regulator will restrict the flow rate from the second zone 22. This allows for a similar flow rate from each zone into the tubing string. The individual characteristics of each production zone of the subterranean formation can be identified prior to production. In this manner, the amount of restriction for each flow rate regulator can be pre-determined and adjusted before introduction into the particular wellbore interval.

The flow rate regulators can be designed to variably restrict the flow rate of a fluid exiting the regulator. The flow rate regulators can be the same or different. According to an embodiment, the flow rate regulator 50 is a nozzle. The nozzle can be held in position with a snap ring and sealed against the adaptor with a small O-ring (not shown). The nozzle can include a choke. The snap ring can be removable to allow for adjusting the choke size of the flow rate regulator 50 nozzle prior to positioning the flow rate regulator in the wellbore interval or introducing the sand control assembly 30 into the wellbore. The flow area between the outside of the sliding sleeve 43 and the outlet of the flow rate regulator 50 can be adjusted as required to fit the nozzle.

The flow rate regulator 50 can be a friction tube. The flow rate regulator 50 can also comprise a fluid passageway (not shown) and a constriction (not shown). The constriction can be a plate that is capable of moving closer to and farther away from a fluid inlet. In this manner, as the flow rate of the fluid increases, the plate can move closer to the inlet, thus maintaining the flow rate of the fluid exiting the flow rate regulator 50 within an optimal flow rate range. The cross-sectional area of the constriction can be less than the cross-sectional area of the fluid passageway.

A pressure differential can be created via the constriction within the fluid passageway. A first pressure can exist at a location upstream of the constriction and a second pressure can exist at a location adjacent to the constriction. As used herein, the term "upstream," with reference to the constriction, means closer to the fluid source and is in the opposite direction of fluid flow. The pressure differential can be calculated by subtracting the second pressure from the first pressure. There can also be a first fluid flow rate or velocity at a location upstream of the constriction and a second fluid flow rate or velocity at a location adjacent to the constriction. According to the Venturi effect, the second flow rate of the fluid increases as the cross-sectional area of the fluid passageway decreases at the constriction. As the second flow rate increases, the second pressure decreases, resulting in an increase in the pressure differential.

The flow rate regulator 50 can maintain the flow rate of the fluid exiting the fluid passageway by choking the flow of the fluid. At initially subsonic upstream conditions, the conservation of mass principle requires the fluid flow rate to increase as it flows through the smaller cross-sectional area of the constriction. At the same time, the Venturi effect causes the second pressure to decrease at the constriction. For liquids, choked flow occurs when the Venturi effect acting on the liquid flow through the constriction decreases the liquid pressure to below that of the liquid vapor pressure at the temperature of the liquid. At that point, the liquid will partially flash into bubbles of vapor. As a result, the formation of vapor bubbles in the liquid at the constriction limits the flow rate from increasing any further.

The cross-sectional area of the constriction can be adjusted, prior to installation of the sand control assembly 30, to maintain the flow rate of the fluid within a desired flow rate range. The choke can be different for each zone. Adjusting the choke allows for a controlled flow rate into a particular wellbore interval. For example, a higher choke can be applied to a higher permeable zone while a lower choke can be applied to a lower permeable zone. Also, depending on the cross-sectional area of the constriction, a fluid containing undissolved solids, such as fines, debris, and proppant, may encounter difficulty flowing through the constriction. Therefore, the number and types of the flow rate regulators 50 selected may depend on the characteristics, including, viscosity and density, of the reservoir fluid.

The flow rate regulator 50 can also be an autonomous flow rate regulator. The autonomous flow rate regulator can variably restrict the flow rate of the fluid exiting the regulator based on a change in: the flow rate of the reservoir fluid entering the regulator; the viscosity of the reservoir fluid; the density of the reservoir fluid; or combinations thereof. The autonomous flow rate regulator can also be designed to provide a desired flow rate range based on the characteristics of the zones of the formation and/or characteristics of the reservoir fluid within each zone.

The reservoir fluid is commingled into a single stream within the tubing string. The fluid is commingled during production of the fluid. By commingling the fluid into a single tubing string, multiple production tubing strings are not needed.

Figure 5:
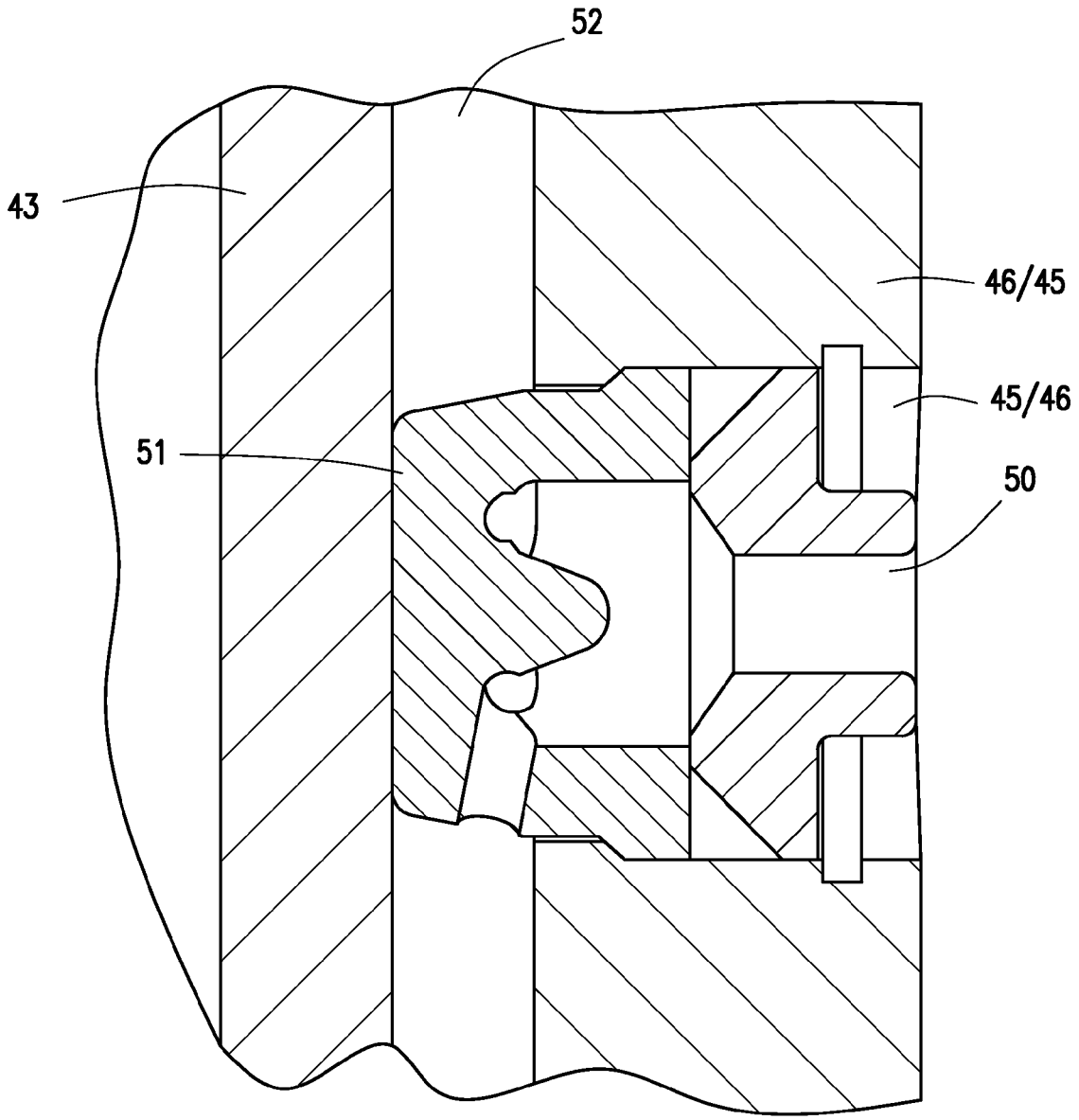
FIG. 5 is an enlarged view showing the sleeve assembly further including a diffuser.

Turning to FIG. 5, the sleeve assembly 40 can further include a diffuser 51. The diffuser 51 can be located abutting or adjacent to the fluid exit of the flow rate regulator 50. The sleeve assembly 40 can also include a second diffuser 51 (not shown) located abutting or adjacent to the fluid inlet of the flow rate regulator 50. The sleeve assembly 40 can also include a diffuser annulus 52. The diffuser annulus 52 can be located between the outside of the sliding sleeve 43 and the inside of the housing 46 and adaptor 45. The diffuser annulus 52 can provide extra space to accommodate the diffuser 51 and a fluid flow path. The diffuser 51 can be sealably connected to the flow rate regulator 50 via one or more seals (not shown). The diffuser 51 is preferably made from an erosion-resistant material, including but not limited to, carbide. According to an embodiment, the diffuser 51 decreases the velocity of the reservoir fluid exiting the flow rate regulator 50. The diffuser 51 can also change the impingement angle of the reservoir fluid relative to components of the sleeve assembly 40 (e.g., the outside of the sliding sleeve 43). By way of example, without the diffuser, the reservoir fluid will tend to exit the flow rate regulator 50 at an angle of approximately 90° (or perpendicular) relative to the outside of the sliding sleeve. This angle can cause the fluid to jet directly onto the outside of the sliding sleeve 43 or other sleeve assembly 40 components. However, with the diffuser 51, the angle can be changed to approximately 180° (or parallel) or other suitable angle. Accordingly, the fluid does not jet directly onto the sleeve assembly 40 components, but rather is diverted away from direct jetting onto the components. The diffuser 51 is also preferably capable of both: decreasing the velocity of the reservoir fluid exiting the flow rate regulator 50; and changing the angle of impingement of the fluid onto any sleeve assembly 40 components. The diffuser 51 can be designed such that a desired decrease in velocity and a desired fluid angle occurs. According to an embodiment, the desired decrease in velocity and fluid angle is such that erosion to the sleeve assembly 40 components and the flow rate regulator 50 are decreased or eliminated.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While apparatus (such as the packer assembly) and methods are described in terms of "comprising," "containing," or "including" various components or steps, the compositions and methods also can "consist essentially of" or "consist of" the various components and steps. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of simultaneously producing a reservoir fluid from more than one zone of a subterranean formation comprising:

(A) positioning a first flow rate regulator in a first interval of the wellbore, wherein the first flow rate regulator is part of a first sand control assembly, wherein the first sand control assembly comprises at least one sleeve assembly, wherein the first sand control assembly comprises a sand control screen, wherein the first flow rate regulator comprises a fluid inlet and a fluid outlet, such that the reservoir fluid is capable of flowing through the flow rate regulator, wherein the at least one sleeve assembly further comprises a diffuser, wherein the diffuser is located abutting or adjacent to the fluid outlet of the first flow rate regulator;

(B) positioning a second flow rate regulator in a second interval of the wellbore, wherein the second flow rate regulator is part of a second sand control assembly, wherein the second sand control assembly comprises at least one sleeve assembly, wherein the second flow rate regulator comprises a fluid inlet and a fluid outlet, such that the reservoir fluid is capable of flowing through the flow rate regulator, wherein the at least one sleeve assembly further comprises a diffuser, wherein the diffuser is located abutting or adjacent to the fluid outlet of the first flow rate regulator; and (C) causing or allowing the reservoir fluid to simultaneously flow through the first and the second flow rate regulators into a tubing string, wherein the reservoir fluid is commingled into a single fluid stream within the tubing string.

2. The method according to claim 1, wherein the wellbore penetrates the subterranean formation, wherein the first interval of the wellbore corresponds to a first zone of the subterranean formation, and wherein the second interval of the wellbore corresponds to a second zone of the subterranean formation.

3. The method according to claim 1, wherein the first and second sand control assemblies comprise a base pipe, wherein the base pipe comprises one or more openings that allow the flow of fluids into the tubing string.

4. The method according to claim 3, wherein the first and second sand control further comprise a sand control screen, wherein the sand control screen is positioned around an outer dimension of the base pipe.

5. The method according to claim 4, wherein the second sand control assembly sleeve assemblies are positioned within or adjacent to the sand control screen.

6. The method according to claim 5, wherein the sleeve assemblies comprise one or more ports.

7. The method according to claim 6, wherein when the sleeve assemblies are in an open position, the port allows fluid flow through the port, and when the sleeve assemblies are in a closed position, fluid flow is prohibited or restricted from flowing through the port.

8. The method according to claim 7, wherein the sleeve assemblies comprise a sliding sleeve.

9. The method according to claim 8, wherein an interior surface of the sliding sleeves comprise a recessed profile that receives a key set carried on a shifting tool.

10. The method according to claim 8, wherein the sliding sleeves are slidably shifted in an axial direction relative to the base pipe via an upward or downward force on the sliding sleeve, and wherein the sliding sleeves are shifted to an open or closed position via the upward or downward force.

11. The method according to claim 10, wherein when the sliding sleeve is shifted into the open position, the reservoir fluid flows through the fluid outlet of the flow rate regulator and into the base pipe via the port of the sliding sleeve.

12. The method according to claim 1, wherein the diffuser decreases the velocity of the reservoir fluid exiting the flow rate regulator and/or wherein the diffuser changes the impingement angle of the reservoir fluid relative to the outside of the sliding sleeve.

13. The method according to claim 1, wherein the first and second flow rate regulators deliver a relatively constant flow rate of the reservoir fluid into the tubing string.

14. The method according to claim 1, wherein the first and second flow rate regulators are a nozzle, a friction tube, or combinations thereof.

15. The method according to claim 1, wherein the first and/or second flow rate regulators are autonomous flow rate regulators.

16. A sand control completion system comprising:

(A) a first flow rate regulator, wherein the first flow rate regulator is positioned in a first interval of a wellbore, wherein the first flow rate regulator is part of a first sand control assembly, wherein the first sand control assembly comprises a sand control screen, wherein the first sand control assembly comprises at least one sleeve assembly, wherein the first flow rate regulator comprises a fluid inlet and a fluid outlet, such that the reservoir fluid is capable of flowing through the flow rate regulator, wherein the at least one sleeve assembly further comprises a diffuser, wherein the diffuser is located abutting or adjacent to the fluid outlet of the first flow rate regulator; and (B) a second flow rate regulator, wherein the second flow rate regulator is positioned in a second interval of the wellbore, wherein the second flow rate regulator is part of a second sand control assembly, wherein the second sand control assembly comprises at least one sleeve assembly, wherein the second flow rate regulator comprises a fluid inlet and a fluid outlet, such that the reservoir fluid is capable of flowing through the flow rate regulator, wherein the at least one sleeve assembly further comprises a diffuser, wherein the diffuser is located abutting or adjacent to the fluid outlet of the first flow rate regulator, wherein the reservoir fluid is capable of being simultaneously flowed through the first and second flow rate regulators into a tubing string, wherein the reservoir fluid is commingled into a single fluid stream within the tubing string.

17. The system according to claim 16, wherein the first and/or second flow rate regulators are a nozzle.

* * * * *